US006009774A

United States Patent [19]

Liedschreiber

[11] Patent Number: 6,009,774

[45] Date of Patent: Jan. 4, 2000

[54] DEVICE FOR MANUALLY SHARPENING CUTTING EDGES OF CUTTING TOOLS

[76] Inventor: Karl Liedschreiber, St.-Martin-Strasse 9, 86647 Pfaffenhofen, Germany

[21] Appl. No.: 08/987,048

[22] Filed: Dec. 10, 1997

[30] Foreign Application Priority Data

Feb. 1, 1997 [DE] Germany ..... 197 03 807

[51] Int. Cl.[7] ..... B24D 15/06

[52] U.S. Cl. ..... 76/82; 76/82.2; 451/555

[58] Field of Search ..... 76/82, 82.1, 82.2, 76/88, 104.1; 451/555, 558, 461

[56] References Cited

U.S. PATENT DOCUMENTS 609,046 8/1898 Poindexter ..... 451/555 X
823,279 6/1906 Kellogg ..... 451/555 X
1,573,875 2/1926 Shaw ..... 451/555 X
3,293,949 12/1966 Lindsay ..... 76/82.2

*Primary Examiner*—Douglas D. Watts
*Attorney, Agent, or Firm*—Jones, Tullar & Cooper, P.C.

[57] ABSTRACT

A manual sharpening device is proposed which may easily be operated and which may universally be used. This new manual sharpening device comprises a shaft-shaped supporting body comprising at least a fork-shaped end having two edge projections comprising two inner flank surfaces being inclined in a V-shaped manner towards each other, a tongue-shaped tool arrangement disposed between the edge projections and comprising a sharpening tool having parallel side edges made of hard metal, and a guide head limiting the sharpening tool at the end distant from the supporting body. The guide head has side flank surfaces which are parallel to the respective adjacent inner flank surfaces of the edge projections, at least the guide head being displaceable in the longitudinal direction of the tool arrangement.

23 Claims, 2 Drawing Sheets

DEVICE FOR MANUALLY SHARPENING CUTTING EDGES OF CUTTING TOOLS

FIELD OF THE INVENTION

The present invention relates to a device for manually sharpening cutting edges of cutting tools, especially of manually operable cutting tools like knives, scissors, etc.

BACKGROUND OF THE INVENTION

The known manual sharpening devices are not easily applicable and only allow inexact sharpening.

Proceeding from this, therefore, the problem to be solved by the present invention is to provide a manual sharpening device which may easily and exactly be operated and which may at the same time be used as universally as possible.

SUMMARY OF THE INVENTION

The solution to this problem is given by a device of the kind mentioned above comprising a shaft-shaped supporting body including at least one fork-shaped end having two edge projections comprising two inner, flank surfaces. The inner flank surfaces are inclined in a V-shaped manner towards each other. The device carries a tongue-shaped tool arrangement disposed between the edge projections which comprises a sharpening tool having parallel side edges made of hard metal and a guide head limiting the sharpening tool at the end distant from the supporting body. The guide head has side flank surfaces parallel to the respective adjacent inner flank surfaces of the edge projections, with at least the guide head being displaceable in the longitudinal direction of the tool arrangement.

The inner width of an insertion gap between the guide head and the lateral edge projections, and therewith the respectively desired sharpening angle may advantageously be adjusted by means of the displaceable guide head. The workpiece to be sharpened is located during the sharpening process, i.e. during pulling through said gap in a reliable, one-sided abutment, thereby insuring angle constancy.

Advantageous embodiments and useful modifications of the superior measures will be evident. Thus, the tool arrangement may advantageously comprise a bar made of hard metal forming the sharpening tool, the bar being disposed in the supporting body continuously adjustable in the longitudinal direction. The bar made of hard metal forming the sharpening tool is a simple and reasonable insertion element which may simply be displaced upon wear of a side edge portion so that a new unused side edge portion is than made available. Thereby, it is ensured that the side edges being engaged with the workpiece to be sharpened may be used over nearly their whole length. Since the hard metal has a long endurance and since the bar-shaped sharpening tool practically may be used over its whole length a long total use life results. Afterwards the sharpening tool may simply be replaced by a new one. Therewith, the mentioned measures result in excellent economic efficiency.

A further advantageous embodiment is that the tongue-shaped tool arrangement is formed as a double slide arrangement including the hard metal bar forming the sharpening tool and a receiving bracket spanning the hard metal bar and carrying the guide head, the tool arrangement engaging with its rear end tightly displaceable in a related insertion recess of the support. As a result, the guide head and the sharpening tool are independently of each other and displaceable relatively to each other. Thereby, it is ensured that neither the total use of the whole length of the sharpening tool nor the exact adjustment of the sharpening angle influence each other negatively.

Advantageously, the supporting body may be provided with a supporting tongue onto which the sharpening tool lies, the tongue being arranged between the lateral projections. This measure results in especially high stability.

According to a further advantageous embodiment the receiving bracket may comprise a bed which is related to the sharpening tool and which is by limited stops, the length of the bed being greater than the length of the sharpening tool. Hereby it is achieved that the sharpening tool is adjustable by means of the receiving bracket carrying the guide head ensuring high operational comfort.

The insertion recess is usefully related to the tool arrangement and may be formed as a through hole open on both sides. Thereby, it is possible to expel the tool arrangement out of the insertion recess by inserting a pushing tool from the backside, and also this has an advantageous effect on operational comfort.

A further useful measure may be that the supporting body preferably comprises in the area behind its fork-shaped end a receiving device for a whetting element having a whetting surface. It is thus possible to provide engagement of the cutting edge being sharpened with the hard metal bar with a finish grinding etc. which is sometimes desired.

A further, especially preferable embodiment may be that the supporting body comprises in the area of one end incorporated in the area of a supporting side flank a bar-shaped sharpening tool to which a pivotably disposed workpiece abutment is related rising over its working surface. Thereby, the plurality of use is further enhanced. The free accessibility of the working surface of the sharpening tool and the pivotable workpiece abutment enable in an advantageous manner an exact sharpening of angle-bound cutting edges as are provided with scissors, vegetable slicers, lawn mowers, etc.

Advantageously, the workpiece abutment may be provided with an operating lever opposite to its pivotable bearing, the lever being usefully formed as an elongation of a bearing flange and advantageously comprises a plate-like cavity. The plate-like cavity enables an operator to put a thumb or another finger in the cavity which facilitates displacement of the workpiece abutment and which especially ensures that the operating lever may be held by pressure in engagement with a supporting body-sided raster resulting in reliable fixing in every angle position of the workpiece abutment. Selected angles may be related to an indexing device.

A further, especially useful measure may be that the pivoting area of the workpiece abutement is limited by end stops on both sides of the pivoting axis, an end stop supporting the workpiece from behind may comprise a backside being domed inwardly. The backside functions in an advantageous way as a supporting face against which an operator may press a finger or thumb without danger of slipping.

Further advantageous embodiments and useful modifications of the superior measures may be taken from the following description of examples.

BRIEF DESCRIPTION OF THE DRAWINGS

In the following a preferred embodiment of the present invention is explained in details by means of the drawings, in which.

DESCRIPTION OF THE PREFERRED EMBODIMENTS

Figure 1:
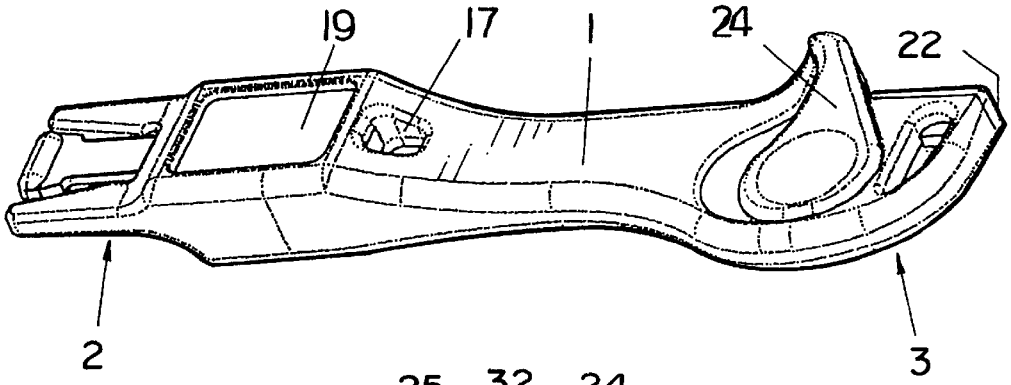
FIG. 1 shows a perspective view of a manual sharpening device according to the present invention.

As is best seen in FIG. 1, the manual sharpening device of the drawings consists of a supporting body 1 formed as a shaft-shaped handle including at each of its two ends a sharpening head 2 and 3, respectively, the one sharpening head 2, here shown at the left, shall be used in the first place for sharpening blades like knife blades, and the other sharpening head 3, here shown at the right side, shall be used in the first place for sharpening angle-bound blades, like cutting edges of scissor knives, lawn mowers, vegetable slicers, etc.

Figure 2:
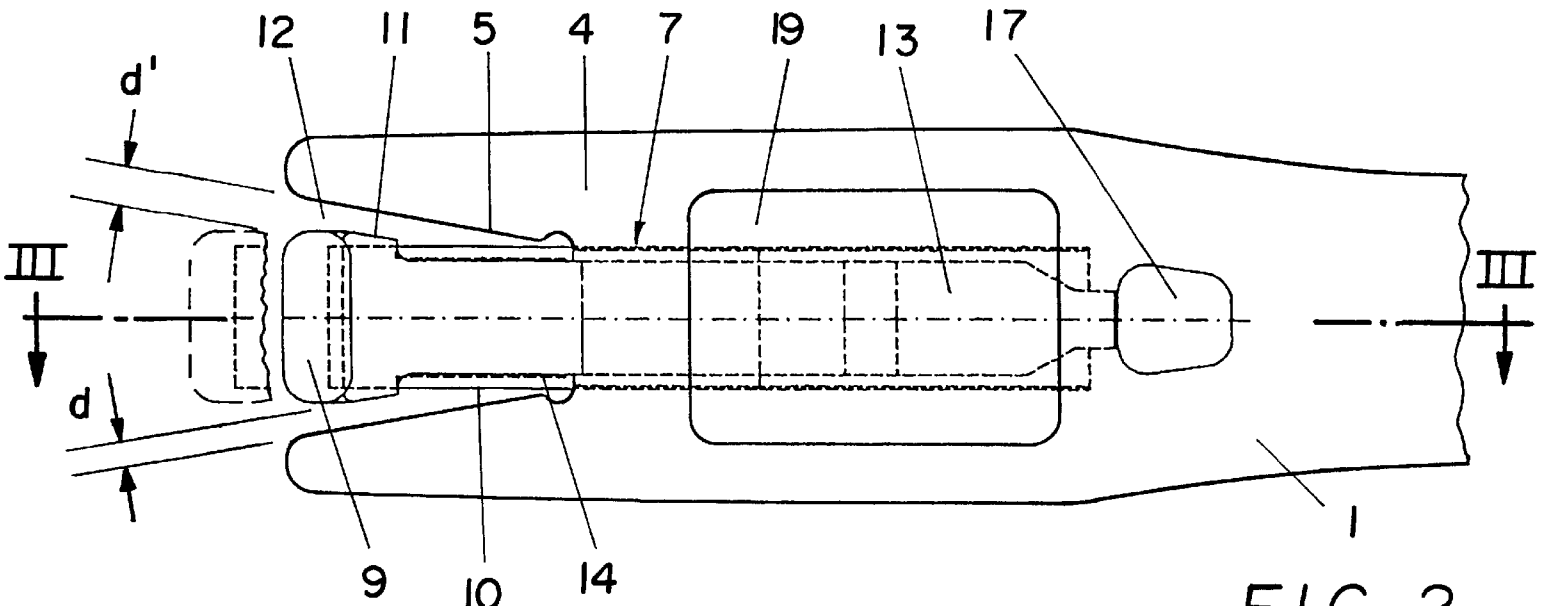
FIG. 2 shows an enlarged top view onto the fork-shaped end portion of the manual sharpening device according to the present invention.

The end of the supporting body 1 related to the sharpening head 2 intended for sharpening of blades, is designed like a fork, as is shown in FIGS. 1 and 2. Accordingly, two lateral edge projections 4 are provided having inner flank surface 5 inclined towards each other in a V-shaped manner. The edge projections 4 flank a central tongue projection which may be seen in FIG. 3. The central tongue projection is formed at the supporting body 1 and serve as a supporting tongue 6 for a tongue-shaped tool arrangement 7 projecting into the recess between the edge projections 4. The tool arrangement 7 includes a bar-shaped sharpening tool 8, here being formed by a bar-shaped hard metal piece, lying on the supporting tongue 6, and a guide head 9 distant from the supporting which receives the end of the sharpening tool 8.

The hard metal bar forming the sharpening tool 8 comprises, as shown in FIG. 2, exposed parallel side edges 10 along which the blade to be sharpened is drawn. It would also be possible to provide a tongue element made e.g. of synthetic material, etc. and only being bordered with lateral hard metal strips instead of a solid hard metal piece. The active area of the side edges 10 is limited, as further shown in FIG. 2, by the guide head 9. The guide head 9 surfaces comprises side flank 11 which are parallel to the inner flank surfaces 5 of the respective adjacent edge projection 4 which laterally project over the exposed side edges 10 of the sharpening tool 8, and together with the adjacent inner flank surfaces 5 form an insertion gap 12 in which the blade to be sharpened is inserted.

Figure 3:
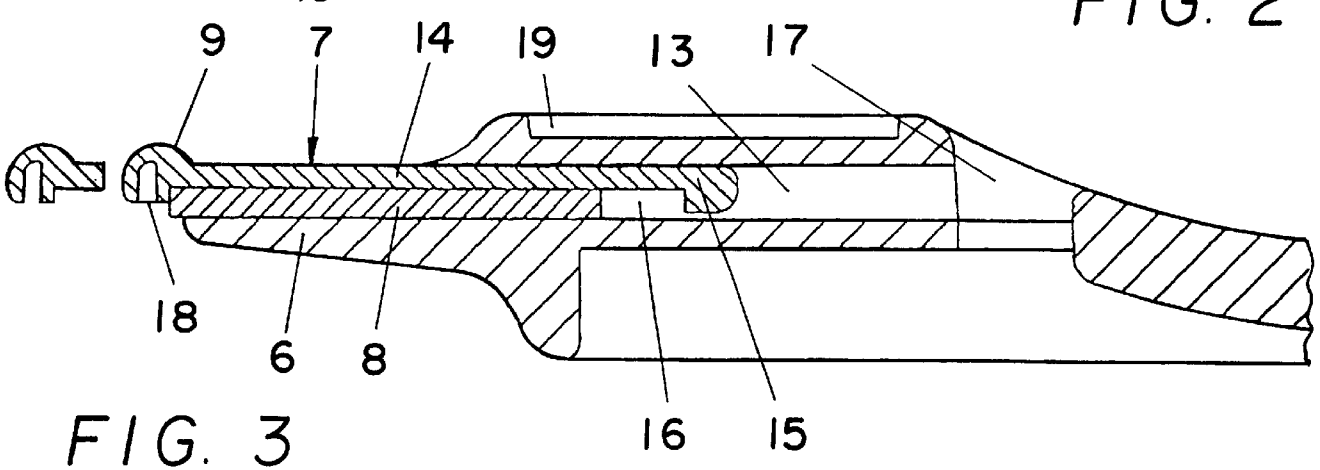
FIG. 3 shows a section taken along the line III/III in FIG. 2.

The guide head 9 is continuously adjustable in the longitudinal direction of the tongue-shaped tool arrangement, i.e. it may be inserted more or less into the space between the edge projections 4 and drawn out of them, respectively, as is indicated in FIGS. 2 and 3 in broken lines. Thereby, the inner width of gap 12 may be changed, as is indicated in FIG. 2 by d and d', respectively. The more the guide head 9 is drawn out of the area between the edge projections 4, the larger will be the inner width of the gap 12. At the same time, the exposed area of the side edges 10 of the bar-shaped sharpening tool 8 is made longer. Therefore, the more the guide head 9 is drawn out of the area between the edge projections 4 the thicker the blade to be sharpened may be and the more a blade being less than the inner width of gap 12 may be tilted, respectively, thereby making the obtainable blade angle adjustable.

The bar-shaped sharpening tool 8 is here also arranged displaceably in the longitudinal direction so that step by step several length portions of the side edges 10 may be brought into the position claimed during the sharpening process. If a portion has become worn out the bar-shaped sharpening tool is just displaced in such a way that a new unused portion is available. If the guide head-sided half of the bar-shaped sharpening tool 8 has become worn out it may be reversed, thereby the firstly opposite half being engaged with an insertion recess 13 of the supporting body 1 related to the tool arrangement 7, may be used.

It might be possible to arranged the guide head 9 firmly on the bar-shaped sharpening tool 8. In this case, the guide head 9 would be adjusted together with the sharpening tool 8.

In the illustrated embodiment, the guide head 9 is displaceable independently from the bar-shaped sharpening tool 8 and vice versa. Accordingly, the guide head 9 is disposed at the end of a receiving bracket 14 lying on the bar-shaped sharpening tool 8 not covering its side edges 10. The bar-shaped sharpening tool 8 and the receiving bracket 14 form a double-slide arrangement being engaged with its rear end in said insertion recess 13 of the supporting body 1. To ensure a reliable support a clamping seat is provided. The insertion recess 13 is in any case so long that both parts, i.e. said sharpening tool 8 and said receiving bracket 14 with the guide head 9 are independently continuously adjustable in the desired range.

To achieve a compact construction the receiving bracket 14 is provided with a bed 16 related to the sharpening tool 8 and being limited by front and rear stops 15 in which the bar-shaped sharpening tool 8 may be inserted. The length of the bed 16 is greater than the length of the bar-shaped sharpening tool 8 so that the desired mutual displaceability is ensured. The excess of the length of the bed 16 is dimensioned such that the bar-shaped sharpening tool is not disengaged with the guide head 9 even if it abuts with its rear edge at the rear stop 15 of the receiving bracket 14. If the sharpening tool already abuts with its rear edge at the rear stop 15 and if the guide head 9 still shall be displaced further outwardly the bar-shaped sharpening tool 8 is displaced together with it.

Figure 4:
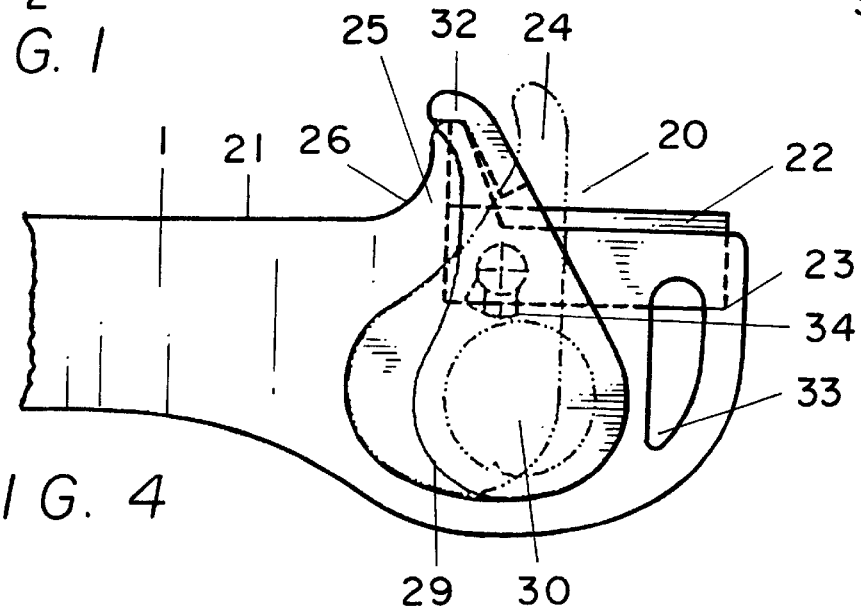
FIG. 4 shows an enlarged top view onto the end portion of the manual sharpening device according to the present invention being provided with a pivotable workpiece abutment.

In the illustrated embodiment the supporting body 1 is provided at the rear end of the receiving recess 13 with an opening 17 extending transversely to it. Thereby, it is achieved that the insertion recess 13 is accessible through said opening 17 from the rear side. Therefore, it is possible for expelling the double-slide arrangement consisting of said sharpening tool 8 and said receiving bracket 14 with the guide head 9 out of the insertion recess 13 by inserting a pin, etc. in said insertion recess from the rear side. Therefore, said double-slide arrangement mentioned above may be arranged with tight clamping seat. As illustrated in FIG. 4, the guide head 9 is provided at its front end with a notch 18 being open towards the lower side and at which also a tool may be applied for displacing said receiving bracket 14 with the guide head 9 and the whole double-slide arrangement, respectively, and which accordingly also serves as an operational aid.

The cutting edges of knife blades which are guided along the free side edges 10 of the sharpening tool 8 being formed by a hard metal bar are sharpened by cutting. Besides, in some cases it may be useful to still whet the cutting edge sharpened in this manner subsequently. For enabling this to be done, on the top of the supporting body 1 a basin-like recess 19 is formed in the area behind its fork-shaped end into which a whet stone comprising a whet surface, an emery paper and a whet linen piece, respectively, may be inserted. Thereby, the fixture may be made non-detachably by means of glueing or detachably by means of clamping or a loop and hook connection.

In the area of the end related to the sharpening head 3 the supporting body 1 is provided with a lateral edge recess 20, as shown in FIGS. 1 and 4, comprising a limitation extending in the direction of the side flank 21 being related to it and a limitation extending transversely to it. A bar-shaped sharpening tool 22 is lying on the limitation of the edge recess 20 extending in the direction of the side flank 21. It is here designed as an upper flange of a hard metal piece 23 having a T-shaped cross-section being engaged by its web with the supporting body 1. Thereby, the hard metal piece may usefully be injected into the supporting body 1 being formed as a plastics injection moulded article or may be disposed interchangeably.

The exposed working surface of the bar-shaped sharpening tool 22 being turned to the edge recess 20 is risen above by a workpiece abutment 24 being pivotable round an axis parallel to the upper working surface of the sharpening tool 22 for exact adjustment of the inclination of the workpiece to be sharpened and therefore, for exact keeping of the inclination of the cutting surface, as is indicated in FIG. 4 by broken lines. Starting from the position indicated in FIG. 4 by interrupted lines being vertical to the working surface of the sharpening tool 22, the pivoting range of the workpiece abutment 24 may comprise at least 30° to the outside so that an angle of at least 120° results. For reduction of wear and therewith for obtaining a high precision over a long endurance, the workpiece abutment 24 is provided with a metal insert 32 in the area of the locating face.

The limitation of the edge recess 20 extending transversely to the working surface of the sharpening tool 22 serves as an end stop 25 for the workpiece abutment 24 in the end position forming an obtuse angle with the working surface of the sharpening tool 22. The back side 26 of the end stop 25 being turned off from the workpiece abutment 24 is domed inwardly. From this, an obvious supporting surface results against which an operator may press a finger or thumb without the danger of slipping off.

Figure 5:
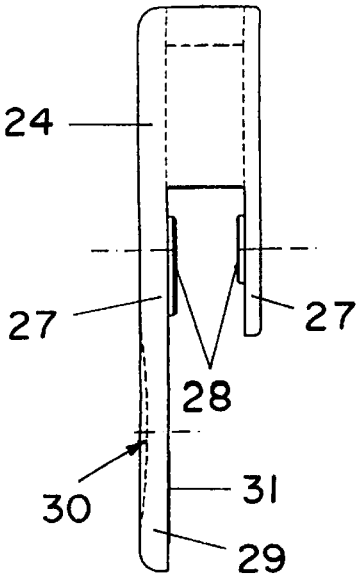
FIG. 5 shows a front view of the component including the pivotable workpiece abutment.
Figure 6:
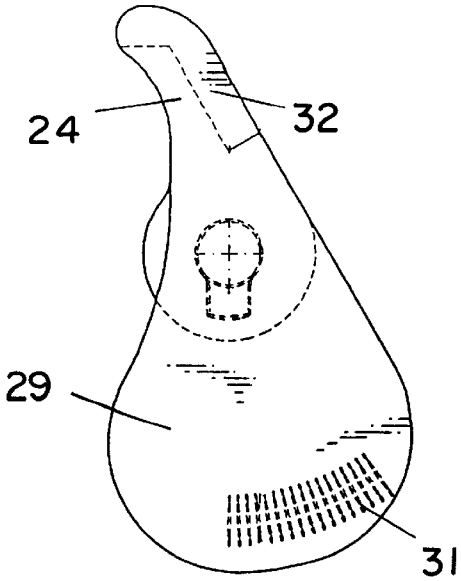
FIG. 6 shows a side view of the component including the pivotable workpiece abutment.

As is shown in FIG. 5, the workpiece abutment 24 is provided with two parallel bearing flanges 27 being provided with bearing stumps 28 projecting inwardly which may be engaged in the mounted state with related bearing recesses of the supporting body 1 being wrapped by the bearing flanges. One of the bearing flanges 27 is prolongated beyond the axis area for formation of an operating lever 29. For facilitation of use said operating lever is broadened disc-like and is provided at its outside with a plate-like cavity 30 into which an operator can take hold with a thumb. In the area of the edge of the operating lever 29, a raster 31 is provided as may best be seen in FIG. 6, being formed by a corrugation which may be hold for engagement with a counter-raster being provided in the area of the opposite surface of the supporting body 1.

Preferred positions of the workpiece abutment 24 may be indexed by means of an indexing device. In the illustrated embodiment, hereto a bearing stump 28 is provided with a beard-shaped base 34 which is related to one or several supporting body indexing recesses. In the illustrated embodiment only the rightangular position of the workpiece abutment 24 indicated by broken lines in FIG. 4 is indexed in this way. Beyond it the beard 34 and the related bearing stumps 28 are disengaged with the supporting body recesses. Fixing of the adjusted position follows by the raster 31 being hold manually engaged with the related supporting body counter-raster. Hereto, pressure is exerted onto the disc-shaped operating lever 29 being facilitated by the plate-like recess 30 into which a thumb may be inserted.

The supporting body 1 as already mentioned above is usefully produced as an injection moulded article consisting of synthetic material, and which may be provided with an eye for hanging it in the non-used state to a pin. In the illustrated embodiment the supporting body 1 is provided in the area of the sharpening head 3 with an opening forming an eye 33. In the area of the opening, the web of the hard metal piece 23 having a T-shaped cross-section also appears enabling expelling it out of its seat by means of a tool in case of a replaceable disposition.

I claim:

1. A device for manually sharpening cutting edges of cutting tools, comprising:

a shaft-shaped supporting body including at least one fork-shaped end having two edge projections comprising two inner flank surfaces inclined in a V-shaped manner towards each other;

a tongue-shaped tool arrangement disposed between said two edge projections, said tongue-shaped tool arrangement defining a longitudinal direction and comprising a sharpening tool having parallel side edges made of hard metal; and a guide head for limiting the location of said sharpening tool at the end of said device which is distant from said supporting body, said guide head having side flank surfaces parallel to the respective adjacent inner flank surfaces of said edge projections, wherein at least said guide head being displaceable in said longitudinal direction of said tool arrangement.

2. The device according to claim 1, wherein said sharpening tool is formed as a bar-shaped hard metal piece.

3. The device according to claim 1, wherein said sharpening tool is disposed in said supporting body, and wherein said sharpening tool is adjustable in said longitudinal direction.

4. The device according to claim 1, wherein said guide head is displaceable relative to said sharpening tool.

5. The device according to claim 1, wherein said sharpening tool is bar-shaped, wherein said tool arrangement is formed as a double-slide arrangement including said bar-shaped sharpening tool and a receiving bracket spanning said sharpening tool and carrying said guide head, wherein said supporting body defines an insertion recess, and wherein said double-slide arrangement engages with its rear end said insertion recess in a tightly displaceable manner.

6. The device according to claim 1, wherein said sharpening tool is bar-shaped, wherein said supporting body has a supporting tongue onto which said hard metal bar-shaped sharpening tool lies, said supporting tongue being arranged between said two edge projections.

7. The device according to claim 4, wherein said sharpening tool is bar-shaped, wherein said receiving bracket comprises a bed which is related to said bar-shaped sharpening tool, the length of said bed being greater than the length of said bar-shaped sharpening tool, and wherein said bed defines stops to limit the movement of said bar-shaped sharpening tool.

8. The device according to claim 4, wherein said insertion recess is formed as a through hole open on both sides.

9. The device according to claim 1, wherein said guide head includes a gripping notch.

10. The device according to claim 1, further comprising:

a whetting element having a whetting surface, wherein said supporting body comprises in an area behind its fork-shaped end an insertion device, and wherein said whetting element is adapted for said insertion device.

11. The device according to claim 1, further comprising:

a further bar-shaped sharpening tool; and a pivotably disposed workpiece abutment, wherein said shaft-shaped supporting body defines a working surface and has a side flank, said further bar-shaped sharpening tool being disposed adjacent said side flank, and wherein said pivotably disposed workpiece abutment rises above the working surface of said shaft-shaped supporting body.

12. The device according to claim 11, wherein said further bar-shaped sharpening tool is formed as a flange of a hard metal profile piece having a T-shaped profile cross-section and a web, and wherein said further bar-shaped sharpening tool engages said shaft-shaped supporting body with said web.

13. The device according to claim 11, wherein said shaft-shaped supporting body has sided bearing bores, and wherein said pivotably disposed workpiece abutment is provided with two bearing flanges for receiving said shaft-shaped supporting body between them, and which are provided with bearing stumps which project inwardly and engage said sided bearing bores.

14. The device according to claim 13, wherein at least one bearing flange comprises a disc-shaped broadened elongation which functions as an operating lever.

15. The device according to claim 14, wherein said at least one bearing flange functioning as an operating lever is provided with a plate-like cavity on its surface.

16. The device according to claim 14, wherein said at least one bearing flange functioning as an operating lever comprises a raster in the area of a distant edge of said pivotably disposed workpiece abutment, and wherein said raster is held in engagement with a counter raster of said shaft-shaped supporting body.

17. The device according to claim 11, further comprising:

an indexing device, wherein said pivotably disposed workpiece abutment is fixed in preferred positions by said indexing device.

18. The device according to claim 11, further comprising:

a plurality of end stops situated on both sides of the pivoting axis of said pivotably disposed workpiece abutment, wherein the pivoting area of said pivotably disposed workpiece abutment is limited by said end stops, and wherein an end stop of said plurality of end stops being provided for supporting said pivotably disposed workpiece abutment from behind, said one end stop is domed inwardly.

19. The device according to claim 11, wherein said pivotably disposed workpiece abutment defines a locating face, and is provided with a metal insert forming its locating face.

20. The device according to claim 11, wherein said shaft-shaped supporting body has an edge recess for receiving said further bar-shaped sharpening tool, said recess defining a stop inwardly from an end of said shaft-shaped supporting body.

21. The device according to claim 1, wherein one end of said shaft-shaped supporting body is provided with a hole forming an eye.

22. The device according to claim 1, wherein said shaft-shaped supporting body is injection molded and comprises a synthetic material.

23. The device according to claim 1, wherein said shaft-shaped supporting body has different sharping heads at its two ends, one of said two different sharpening heads serving to sharpen blades and the other serving to sharpen angle-bound cutting-edges.

* * * * *